US006684787B1

(12) United States Patent
Sauer

(10) Patent No.: US 6,684,787 B1
(45) Date of Patent: Feb. 3, 2004

(54) METHOD AND DEVICE FOR PROCESSING PRINTED MATERIALS

(75) Inventor: Hartmut Karl Sauer, Himmelstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 32 days.

(21) Appl. No.: 10/048,997

(22) PCT Filed: Aug. 11, 2000

(86) PCT No.: PCT/DE00/02698

§ 371 (c)(1),
(2), (4) Date: Feb. 19, 2002

(87) PCT Pub. No.: WO01/15091

PCT Pub. Date: Mar. 1, 2001

(30) Foreign Application Priority Data

Aug. 20, 1999 (DE) ..... 199 39 164

(51) Int. Cl.[7] ..... B41E 1/54

(52) U.S. Cl. ..... 101/484; 101/2; 101/224; 101/240; 400/74

(58) Field of Search ..... 101/484, 2, 224, 101/240; 400/74

(56) References Cited

U.S. PATENT DOCUMENTS

| | | | | |
|---|---|---|---|---|
| 3,023,900 A | * | 3/1962 | Thier | 209/3.2 |
| 3,949,979 A | * | 4/1976 | Taylor et al. | 271/10.01 |
| 3,988,571 A | * | 10/1976 | Blair et al. | 235/379 |
| 4,250,806 A | * | 2/1981 | Boyson et al. | 101/2 |
| 4,459,013 A | * | 7/1984 | Hamlin et al. | 355/23 |
| 4,793,251 A | | 12/1988 | Kuhfus | |
| 5,016,059 A | * | 5/1991 | Smeiman | 399/80 |
| 6,010,257 A | * | 1/2000 | Petteruti et al. | 400/88 |

FOREIGN PATENT DOCUMENTS

| | | |
|---|---|---|
| DE | 29 21 862 | 12/1979 |
| DE | 30 34 212 C2 | 11/1982 |
| DE | 32 40 217 C2 | 10/1988 |
| DE | 297 14 114 U1 | 1/1999 |
| EP | 0 737 936 A1 | 10/1996 |
| EP | 0 867 842 A1 | 9/1998 |
| GB | 2 023 547 A | 1/1980 |

* cited by examiner

*Primary Examiner*—Andrew H. Hirshfeld
*Assistant Examiner*—Andrea H. Evans
(74) *Attorney, Agent, or Firm*—Jones, Tullar & Cooper, PC

(57) ABSTRACT

Sheets or strips of printed materials, with each sheet or strip having a printed image including plural individual copies, are inspected. Each copy is inspected by an inspection device. The sheets or strips of printed materials are separated into individual ones of the copies. Defective copies are sorted out based on the results of the inspection device.

28 Claims, 1 Drawing Sheet

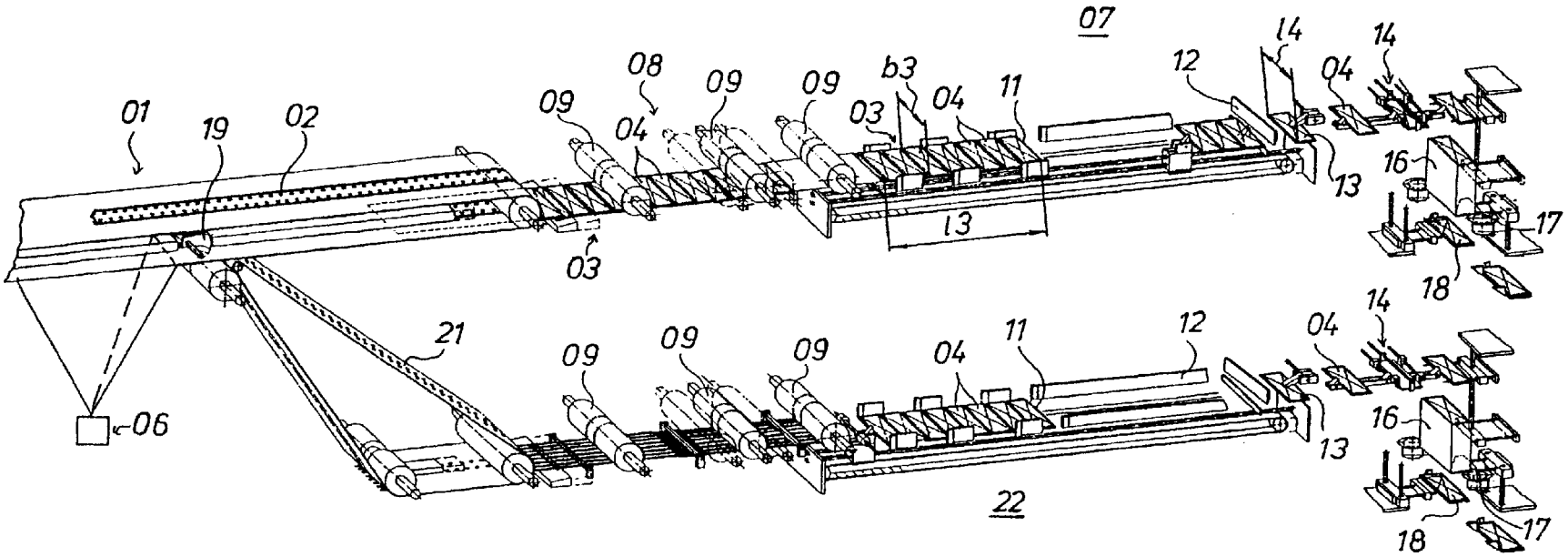
07
22
01
02
03
04
06
08
09
11
12
13
14
16
17
18
19
21
b3
l3

METHOD AND DEVICE FOR PROCESSING PRINTED MATERIALS

FIELD OF THE INVENTION

The present invention relates to methods and to a device for processing printed materials. Printed images on a plurality of copies of printing material are checked. Defective copies are detected and extracted.

DESCRIPTION OF THE PRIOR ART

DE 29 21 862 A1 discloses a machine for checking sheets imprinted with several bills. Individual defective bills are marked in the process and the associated entire sheet is extracted.

DE 32 40 217 C2 describes a method for checking sheets of securities, wherein several sheets with copies are checked. The position of these sheets is monitored during the processing operation.

U.S. Pat. No. 4,793,251 shows a device for processing printed materials whose printed image has several copies. The printed material is inspected and divided into individual copies. Defective copies are extracted. A counting device is also connected downstream of the inspection device.

SUMMARY OF THE INVENTION

The object of the present invention is based on providing methods and a device for processing printed materials.

In accordance with the present invention, the object is attained by inspecting a printed image on printed material in which the printed image has a plurality of copies. Defective ones of these copies are detected. The plurality of copies of the printed image are separated into individual copies, typically by cutting the sheet of printed material. The individual images are arranged into stacks and the stacks of defective copies are removed.

The advantages which can be achieved with the present invention reside, in particular, in that a processing speed of the printed materials containing several copies can be increased in comparison with the processing of single copies.

Furthermore, waste is reduced in comparison with the processing of printed materials having several copies, since only the defective copies are extracted.

BRIEF DESCRIPTION OF THE DRAWING

A preferred embodiment of the present invention is represented in the sole drawing and will be explained in greater detail in what follows.

The sole drawing shows a schematic representation of a device for processing printed materials in accordance with the present invention.

DESCRIPTION OF THE PREFERRED EMBODIMENT

A conveying device 01 has a suction belt 02 or several suction belts 02, for example. This conveying device 01 conveys printed materials 03, each with a plurality of copies 04, as seen in the sole drawing figure.

The printed materials 03 can be sheets of printed material and each sheet can be imprinted with a plurality of copies 04 arranged behind and next to each other. Printed materials 03 can also be configured as elongated strips and can be each imprinted with a plurality of copies 04 arranged one behind the other. A width b3 of the strip 03 in this case preferably corresponds approximately to a length 14 of a copy 04.

For example, the copies 04 can be embodied as securities, in particular as bills 04, as labels or as packaging, in particular as collapsible boxes.

For simplification, printed material 03 embodied as strips 03 of printed material will be described hereinafter by way of example. It will be understood that this discussion is equally applicable to sheets of printed materials 03.

At least one inspection device 06, which is used for checking the printed image of the plurality of copies 04 arranged on the printed material 03, is assigned to this conveying device 01. The front and back of each of the copies 04 on the printed material 03 are preferably checked by the inspection device 06.

The inspection device 06 detects defective copies 04, and, in particular, detects a position of a defective copy 04 on each strip 03.

A first processing track 07, with a device 08 for forming stacks of strips 03, is arranged following the inspection device 06. In the process in accordance with the present invention, the strips 03 are grasped by suction rollers 09, for example, and are slowed down. The slowdown can take place in a single stage or in several stages. The strips 03 are initially overlapped in the manner of fish scales and are finally deposited on a stack 11 of strips 03. For example, when processing bills 04, each stack 11 has a fixed number of strips 03.

This stack 11 of strips 03, consisting of strips 03 placed on top of each other, is then conducted to a cutting device, for example a transverse cutting device 12. This transverse cutting device 12 separates the strips 03 in the stack 11 into individual copies 04, so that individual stacks 13, or bundles of copies 04 with these stacks or bundles 13 of copies 04 arranged on top of each other, are formed.

These stacks 13 of the groups of copies 04 from the strips 03 placed on top of each other, are conducted to a device 14 for straightening, which aligns the groups of copies 04 of a stack 13 along their lateral edges.

The stacks 13 are subsequently conveyed to a hopper 16. A counting device 17 is assigned to this hopper 16. A suitable counting device 17, which could be used in this application is known from EP 0 737 936 A1, for example, and has a rotating counting disk.

Based on the position of the defective copy or copies 04 in each strip 03, as determined by the inspection device 06, the position of the defective copy or copies 04 within the stack 13 or inside the hopper 16 is calculated, for example by utilization of a computer. The counting device 17 determines the position of the copies 04 fed to the hopper 16 and conducts an appropriate signal to the computer for a comparison of the determined positions of the copies 04 in the hopper 16 with the calculated position of the defective copy 04.

If now the position of the defective copy 04 is fixed, the counting device 17, for example, is stopped and the defective copy 04 is extracted from the stack 18, for example by use of a generally known device, which is not specifically represented, for extracting copies 04.

It is also possible to issue a signal ahead of the expected defective copy 04 and/or to reduce the speed of the counting device 17.

Stacks 18 of a fixed number of copies 04, for example stacks 18 of 100 copies 04 each, when processing bills, are formed by the counting device 17.

It is also possible to integrate a device, which is not specifically represented, into the counting device for checking the accuracy of the cut copies 04, i.e. to determine a distance between a lateral edge and the printed image of the piece 04.

These stacks 18 of fixed numbers of copies 04 can be conveyed on to further processing devices, to devices for example for putting a band around them.

The processing of the printed materials 03 from the inspection device 06 to the counting device 17 takes place inside one machine, i.e. "in line".

A shunt 19, with an associated conveying device 21, can be arranged after the inspection device 06, as also seen in the sole drawing. A second processing track 22 is arranged after this conveying device 21. Essentially this second processing track 22 is constructed corresponding to the first processing track 07. Checked printed materials 03 can be alternatingly conducted to these two processing tracks 07, 22, and in this way both processing tracks 07, 22 can be operated simultaneously. An increased processing speed is possible in this way.

Alternatively a second such processing track 22 can be provided solely for processing printed materials 03 having defective copies 04, and one or several further first processing tracks 07 can be provided for processing printed materials 03 having no defective copies 04.

While a preferred embodiment of a method and device for processing printed materials in accordance with the present invention has been set forth fully and completely hereinabove, it will be apparent to one of skill in the art that various changes in, for example, the specific sheet or strip conveyors, the type of inspection devices, the type of stackers and the like could be made without departing from the true spirit and scope of the present invention which is to be limited only by the following claims.

What is claimed is:

1. A method for processing printed materials including:

providing printed materials with each said printed material having a printed image, each said printed image including a plurality of printed copies;

providing a printed image inspection device;

inspecting said plurality of printed copies on each of said printed materials using said printed image inspection device;

using said printed image inspection device and detecting defective ones of said plurality of printed copies on each said printed image;

providing a first conveying track for printed materials each having no defective ones of said plurality of printed copies;

providing a second conveying track for printed materials each having at least one defective one of said plurality of printed copies;

removing said printed materials having at least one defective one of said plurality of printed copies from said first conveying track;

directing said printed material having at least one defective one of said plurality of printed copies to said second conveying track;

separating said printed materials on both of said first and second conveying tracks into said plurality of printed copies and removing said defective ones of said printed copies in said second conveying track.

2. A method for processing printed materials including:

providing printed materials each having a printed image including a plurality of printed copies;

providing a printed image inspection device;

inspecting said plurality of printed copies on each of said printed materials using said printed image inspection device;

detecting a position of defective printed copies on each of said printed materials using said printed image inspection device;

providing a printed material separating device after, in a direction of printed material travel, said printed image inspection device;

separating said printed materials into individual printed copies using said printed material separating device;

arranging said individual printed copies in stacks of printed copies;

using said detected position of defective ones of said printed copies for determining a location of said defective printed copies in said stacks of printed copies and;

separating said defective printed copies in said stacks of printed copies using said detected position of defective printed copies provided by said printed image inspection device located before said printed material separating device.

3. The method of claim 2 further including separating stacks containing defective printed copies from a conveying track for stacks free of defective printed copies.

4. The method of claim 1 further including forming stacks of said individual printed copies and determining a position of defective ones of said printed copies in said stacks.

5. The method of claim 2 further including providing a stack counting device and conveying a stack of printed copies including defective printed copies to said stack counting device.

6. The method of claim 5 further including using said stack counting device and issuing a signal when a defective printed copy in said stack of printed copies including defective printed copies is reached.

7. The method of claim 6 further including interrupting counting of said stack when a defective printed copy in said stack of printed copies including defective printed copies is reached.

8. The method of claim 7 further including extracting said defective printed copy from said stack.

9. The method of claim 5 further including using said counting device and issuing a signal before a defective printed copy in said stack of printed copies including defective printed copies is reached.

10. The method of claim 1 wherein said printed materials are sheets and further whereas said plurality of printed copies are arranged on each of said sheets.

11. The method of claim 2 wherein said printed materials are sheets and further whereas said plurality of Printed copies are arranged on each of said sheets.

12. The method of claim 1 wherein said printed materials are strips and further wherein said plurality of printed copies are arranged on each of said strips, each said strip having a width and each said printed copy having a length, said strip width being equal to said printed copy length.

13. The method of claim 2 wherein said printed materials are strips and further wherein said plurality of printed copies are arranged on each of said strips, each said strip having a width and each said printed copy having a length, said strip width being equal to said copy length.

14. The method of claim 1 wherein said printed copies are securities.

15. The method of claim 2 wherein said printed copies are securities.

16. The method of claim 1 wherein said printed copies are bills.

17. The method of claim 2 wherein said printed copies are bills.

18. The method of claim 1 wherein said printed copies are labels.

19. The method of claim 2 wherein said printed copies are labels.

20. The method of claim 1 wherein said printed copies are collapsible boxes.

21. The method of claim 2 wherein said printed copies are collapsible boxes.

22. The method of claim 1 further including arranging said printed materials into several layers and then separating said printed materials into said individual printed copies.

23. The method of claim 2 further including arranging said printed materials into several layers and then separating said printed materials into said individual printed copies.

24. The method of claim 1 further including arranging said individual printed copies in several layers.

25. The method of claim 2 further including arranging said individual printed copies in several layers.

26. A device for processing printed materials comprising:

a printed materials conveying device;

an inspection device adapted to inspect plural printed copies of printed images on printed materials conveyed by said printed materials conveying device and to determine a position of defective ones of the printed copies;

a cutting device adapted to separate printed materials into individual printed copies, said cutting device being located after said inspection device in a direction of travel of the printed materials;

a counting device for counting individual ones of the plural printed copies of printed images on printed materials, said counting device being located downstream of said cutting device in said direction of travel of printed materials; and means for operating said counting device in response to said inspection device to remove defective ones of the printed copies from the plural printed copies of printed images.

27. The device of claim 26 further including a stack straightening device after said cutting device.

28. The device of claim 26 further including a hopper associated with said counting device.

* * * * *